US006385814B1

(12) United States Patent
Krumwiede

(10) Patent No.: US 6,385,814 B1
(45) Date of Patent: May 14, 2002

(54) TAMPER-RESISTANT, ADJUSTABLE TABLE GLIDE

(75) Inventor: Troy Richard Krumwiede, Onarga, IL (US)

(73) Assignee: Richard B. Karl, St. Charles, IL (US)

( * ) Notice: Subject to any disclaimer, the term of this patent is extended or adjusted under 35 U.S.C. 154(b) by 0 days.

(21) Appl. No.: 09/440,879

(22) Filed: Nov. 16, 1999

(51) Int. Cl.[7] ..... A47B 91/06

(52) U.S. Cl. ..... 16/42 R; 16/32; 16/42 T

(58) Field of Search ..... 16/32, 42 R, 19, 16/42 T; 248/180.1, 188.2, 188.4, 188.8, 188.9

(56) References Cited

U.S. PATENT DOCUMENTS

| | | | | | |
|---|---|---|---|---|---|
| 2,403,338 | A | * | 7/1946 | Butler | 311/4 |
| 2,499,277 | A | * | 2/1950 | Nalle | 16/19 |
| 2,608,794 | A | * | 9/1952 | Matter | 45/139 |
| 2,940,784 | A | * | 6/1960 | Fell | 287/62 |
| 4,041,881 | A | | 8/1977 | Textoris et al. | |
| 4,205,876 | A | | 6/1980 | Cetina | |
| 4,593,590 | A | | 6/1986 | Gray | |
| 4,662,591 | A | | 5/1987 | Encontre | |
| 4,726,556 | A | | 2/1988 | Weir | |
| 4,819,569 | A | | 4/1989 | Bastian et al. | |
| 4,876,782 | A | | 10/1989 | Carpinella et al. | |
| 5,010,621 | A | | 4/1991 | Bock | |
| 5,042,764 | A | | 8/1991 | Carpinella et al. | |
| 5,142,734 | A | * | 9/1992 | Looman et al. | 16/19 |
| 5,203,528 | A | | 4/1993 | Oke | |
| 5,289,782 | A | | 3/1994 | Rizzi et al. | |
| 5,320,049 | A | | 6/1994 | Rowland | |
| 5,341,749 | A | | 8/1994 | Noakes | |
| 5,438,937 | A | | 8/1995 | Ball et al. | |
| 5,533,457 | A | | 7/1996 | Cox | |
| 5,577,818 | A | | 11/1996 | Sayre | |
| 5,630,760 | A | | 5/1997 | Brown et al. | |
| 5,881,979 | A | * | 3/1999 | Rozier, Jr. et al. | 248/188.5 |

* cited by examiner

*Primary Examiner*—Lynne H. Browne
*Assistant Examiner*—John B. Walsh
(74) *Attorney, Agent, or Firm*—Mathew R. P. Perrone, Jr.

(57) ABSTRACT

A tamper-resistant, adjustable table glide fits to the leg of a table in a permanent manner, while still permitting a height adjustment of the table, and hence permitting the table top to be levelled.

18 Claims, 2 Drawing Sheets

TAMPER-RESISTANT, ADJUSTABLE TABLE GLIDE

This invention relates to a table glide and more particularly to a tamper-resistant, adjustable table glide which is permanently attached to the table.

BACKGROUND OF THE INVENTION

A table glide is a convenient device installed on a table leg. This glide is design to provide contact with the floor for the table, and specifically contact for the table leg with the floor. The glide may be used to adjust the height of the table or the stability of the table or the level of the table in order to compensate for a floor, which is not quite level.

The glide may also compensate for a table, the leg or legs, of which, are not manufactured completely and accurately to have the same length.

The glide may also provide an easing of friction between the floor and the table. This reduction of friction permits the table to be moved more easily. Such easing of friction may also minimize damage to both the table and the floor, on which the table rests.

The glide generally has a threaded nature, which permits the glide to be adjusted up and down as desired within certain parameters in order to permit the table to be properly positioned and made level. Like many ordinary items, such glides, while quite useful under normal conditions, can create great problems in a confined situation, such as a prison. It is very possible to remove one or more these glides from the table. Upon removal, the threaded stem or portion of the glide may be sharpened, in order for the glide to be used as a weapon.

Even more common is vandalism. If a glide is removed, the table becomes unbalanced. With such unbalance, the table cannot be used as effectively. At best, the glide must be replaced to regain balance. At worst, the table itself may have to be replaced. If vandalism can be reduced, great advantages are obtained It is very desirable to prevent this problem and to minimize any opportunity to use the glide as a weapon. Yet, it is very desirable to retain the advantages provide by the glide. Thus, a device, which can lock the glide to a table leg, while retaining the action of the glide, provides tremendous advantages.

SUMMARY OF THE INVENTION

Among the many objectives of this invention is the provision of a tamper-resistant, adjustable table glide suitable for permanent attachment to a leg of a table.

Another objective of this invention is to provide a tamper-resistant, adjustable table glide, wherein the table glide provides a height adjustment for the leg of the table.

Yet another objective of this invention is to provide a tamper-resistant, adjustable table glide, which is permanently attached to the table leg. Still another objective of this invention is to provide a tamper-resistant, adjustable table glide, which is adjustable.

Additionally, an objective of this invention is to provide a tamper-resistant, adjustable table glide, which may not be removed from the table.

Also, an objective of this invention is to provide a tamper-resistant, adjustable table glide, which can minimize the difficulty in obtaining a precise positioning required for tamper-resistant, adjustable table glide.

A further objective of this invention is to provide a tamper-resistant, adjustable table glide, which is easily installed.

A still further objective of this invention is to provide a tamper-resistant, adjustable table glide, which reduces vandalism.

These and other objectives of the invention (which other objectives become clear by consideration of the specification, claims and drawings as a whole) are met by providing a tamper-resistant, adjustable table glide, which fits into the leg of a table in a permanent manner, while still permitting a height adjustment of the table, and hence permitting the table top to be levelled.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

A tamper-resistant, adjustable table glide, which fits into the leg of a table in a permanent manner provides for the levelling of the table or adjusting of the length of the table leg, while still permitting security at an institution. This tamper-resistant feature is accomplished by putting a stop mechanism on the top of the glide.

The glide includes a mounting member secured to a floor contact member. The mounting member secures the floor contact member to the leg of the table. The mounting member includes an outer threaded cylinder and a threaded glide mount.

Within the table leg is a threaded insert as part of a positioning means. The threaded insert fits into a threaded relation with the outer threads of the outer threaded cylinder. The inner threads of the outer threaded cylinder receive the threaded glide attachment. The threaded glide attachment is locked into the outer threaded cylinder by a tamper proof fastener at a glide end thereof.

Oppositely disposed from the threaded glide attachment and on the opposing end of the outer threaded cylinder is a collar head. The collar head provides a part of the securing means and a part of the mounting member for the glide, and is thus internal to the leg tube, when the tamper-resistant, adjustable table glide is assembled. The collar head prevents removal of the tamper-resistant, adjustable table glide from the table leg. The collar head is preferably of metal and must be of sufficient size to prevent the glide being removed from the leg tube.

More particularly, the tamper-resistant, adjustable table glide has the threaded insert mounted in a closure. The male portion of the glide includes the threaded glide attachment and the outer threaded cylinder. The outer threaded cylinder fits into the threaded insert. This closure is then secured into a leg tube of the table.

The closure may be inserted into a leg tube of the table, and welded or otherwise permanently secured to the leg tube of the table. In this fashion, the installation of the tamper-resistant, adjustable table glide can be accomplished and removal thereof can be prevented.

Two threaded members, the outer threaded member and the threaded glide attachment, extend upwardly from the floor contact member of the glide. The outer threaded member provides adjustability by a male-female relationship with the threaded insert. The outer threaded member also receives the threaded glide attachment and locks the floor contact member to the table. In this fashion, great advantages may be obtained.

Figure 1:
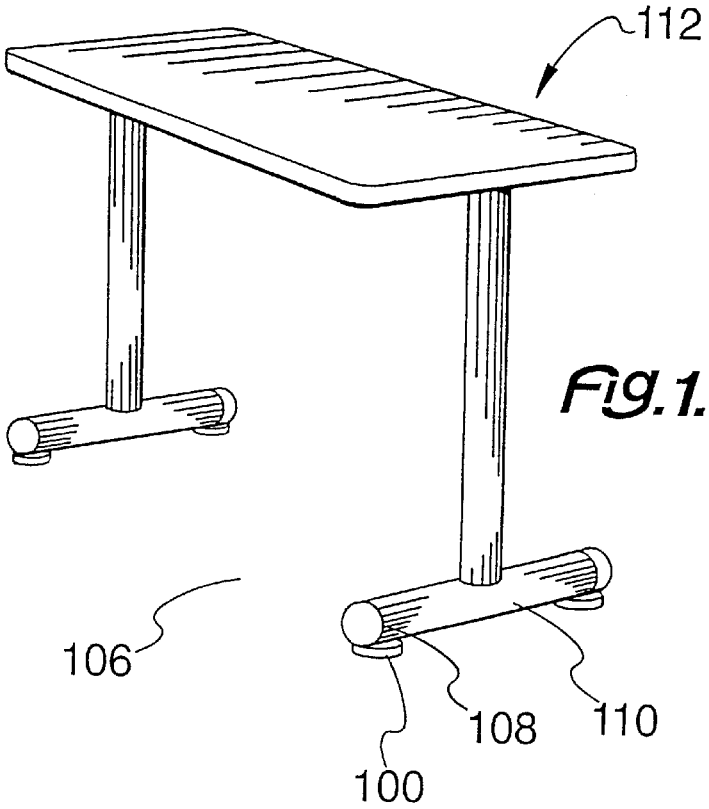
FIG. 1 depicts a perspective view of the tamper-resistant, adjustable table glide 100 of this invention installed on a table 112.

Referring now to FIG. 1, the tamper-resistant, adjustable table glide 100 of this invention rests on floor 106 as it is mounted on closure 108. The closure 108 is mounted in the leg tube 110 of table 112. The access to the glide 100, leg tube 110 and closure 108 can be prevented by welding or otherwise securing closure 108 to leg tube 110.

Figure 2:
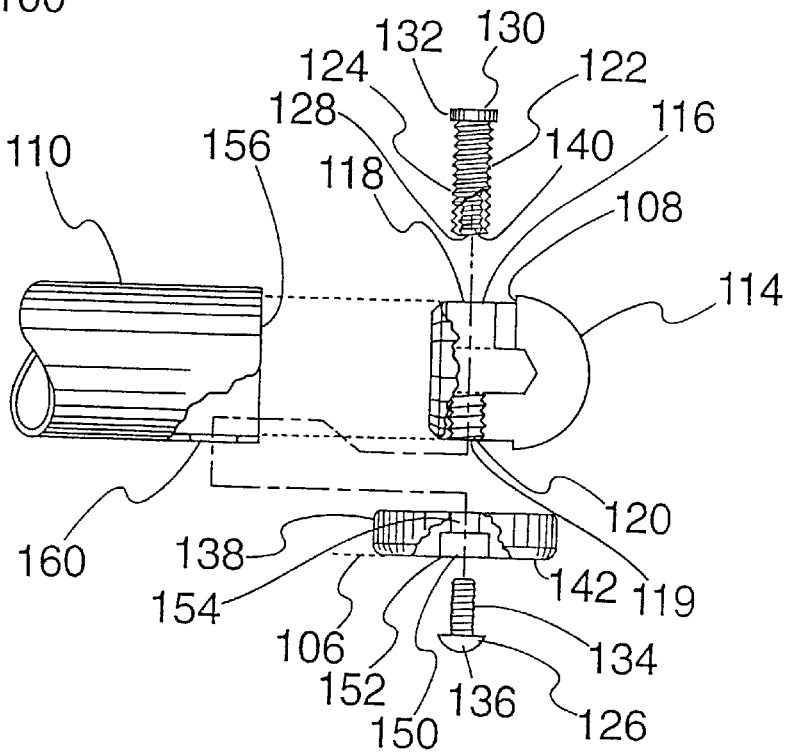
FIG. 2 depicts an exploded, side view of tamper-resistant, adjustable table glide 100 of this invention.

More particularly, with reference to FIG. 2, the closure 108 has an end cap 114 with travel cylinder 116 located at the topside 118 extending therefrom. Travel cylinder 116 slides within the leg tube 110, with a limit of travel provided by end cap 114. End cap 114 is welded or otherwise secured to leg tube 110.

Molded or otherwise formed at the bottom side 119 within travel cylinder 116 is a threaded aperture 120. Threaded aperture 120 receives threaded cylindrical insert 122 at the outer threads 124 thereof. Threaded aperture 120 receives tamper proof fastener 126 through threaded cylindrical insert 122 at an outer end 128 thereof. Oppositely disposed from outer end 128 of threaded cylindrical insert 122 is inner end 130. To inner end 130 is permanently secured collar head 132.

The tamper proof fastener 126 includes screw threads 134 and unremovable head 136. By unremovable head 136, is meant a screw head, which permits the threads to be turned only in the tightening direction. Screw threads 134 fit through glider 138 into the threaded cylindrical insert 122 in a male-female threaded relationship with the inner threads 140 of threaded cylindrical insert 122. Glider 138 has a reduced friction surface 142 in contact with floor 106 (FIG. 1).

Figure 3:
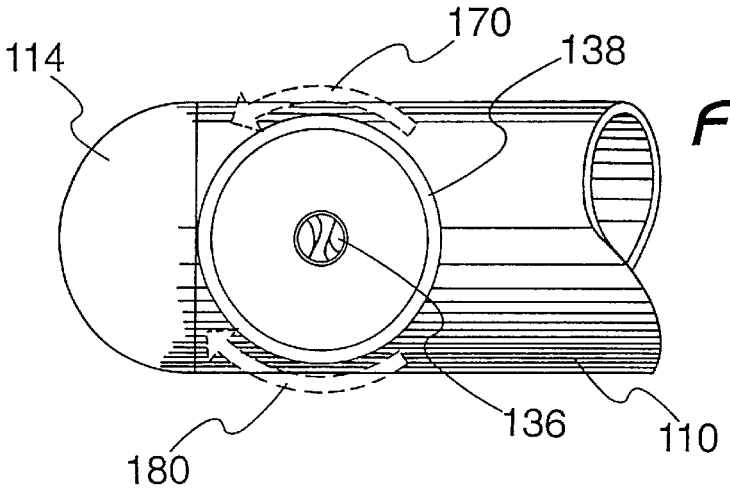
FIG. 3 depicts a bottom, plan view of tamper-resistant, adjustable table glide 100 of this invention.

Adding FIG. 3 to the consideration, centrally located in glider 138 is a stepped aperture 150. Stepped aperture 150 has enlarged portion 152 adjacent to floor 106 in order to receive unremovable head 136, so that unremovable head 136 will not contact floor 106, while the reduced friction surface 142 will make such contact.

With reduced portion 154 adjacent to enlarged portion 152 in stepped aperture 150, screw threads 134 permit unremovable attachment of the glide 13B. In this fashion for securing means, unremovable head 136 coatings with collar head 132, in order to prevent removal of tamper-resistant, adjustable table glide 100 from table 112 (FIG. 1).

As can be seen leg tube 110 and closure 108 cooperate. Leg tube 110 has a closure receiving aperture 156 at the end thereof to receive travel cylinder 116 and hence closure 108. Travel cylinder 116 has a threaded aperture 120 on a bottom side thereof in order to receive threaded cylindrical insert 122. In the side thereof, leg tube 110 also has a glide aperture 160 to receive screw threads 134 into threaded cylindrical insert 122, and thereby mount tamper-resistant, adjustable table glide 100 on table 112 (FIG. 1).

Figure 4:
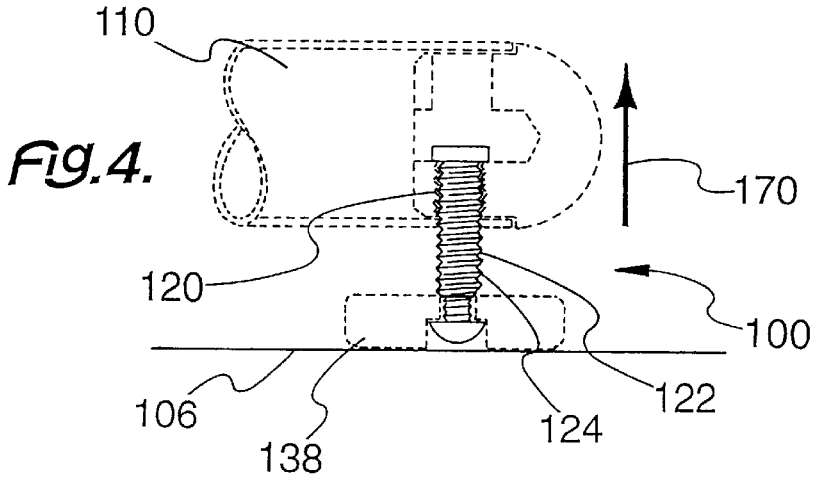
FIG. 4 depicts a side view of tamper-resistant, adjustable table glide 100 of this invention, in the maximum extended position 170.

Now as seen in combination with FIG. 2, FIG. 3 and FIG. 4, the tamper-resistant, adjustable table Slide 100 achieves unremovable characteristics combined with adjustability due the use of threaded aperture 120 and cooperating structures. To provide a positioning means, threaded aperture 120 receives threaded cylindrical insert 122 at the outer threads 124 thereof, and permits positioning of glider 138 either up or down, as desired. Such adjustment is limited by collar head 132, which provides the mounting member.

The presence of the collar head 132 on the threaded cylindrical insert 122 prohibits the removal of the tamper-resistant, adjustable table glide 100 from the table 112. The tamper proof fastener 126 can be used to secure the glide 100 to the closure 108.

Figure 5:
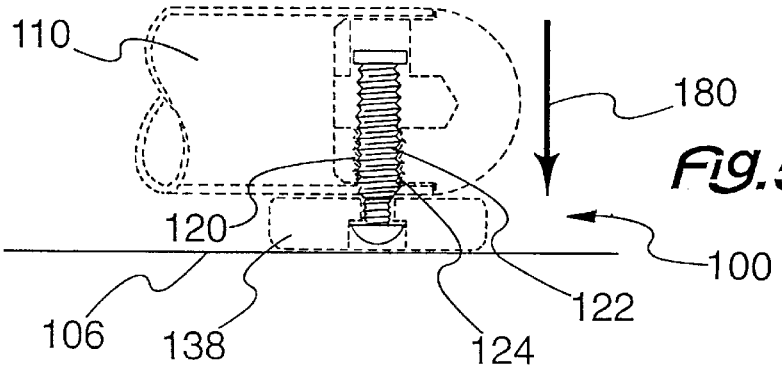
FIG. 5 depicts a side view of tamper-resistant, adjustable table glide 100 of this invention, in the closed position 180.

By viewing FIG. 4 and FIG. 5, one may see the difference between maximum extended position 170 (FIG. 4) and closed position 180 (FIG. 5). By using at least three and preferably four of glide 100, table 112 may be levelled. The chance for removal of glide 100 from table 112 is almost nonexistent.

This application—taken as a whole with the abstract, specification, claims, and drawings being combined—provides sufficient information for a person having ordinary skill in the art to practice the invention as disclosed and claimed herein. Any measures necessary to practice this invention are well within the skill of a person having ordinary skill in this art after that person has made a careful study of this disclosure.

Because of this disclosure and solely because of this disclosure, modification of this method and device can become clear to a person having ordinary skill in this particular art. Such modifications are clearly covered by this disclosure.

What is claimed and sought to be protected by Letters Patent of the United States is:

1. A table glide adapted for a permanent attachment to a leg of a table comprising:

(a) a mounting member being secured to a floor contact member;

(b) the mounting member being adapted to secure the floor contact member to the leg;

(c) the mounting member including an outer threaded cylinder and a threaded glide mount;

(d) the mounting member being adapted to cooperate with a securing means on the leg in order to permanently secure the floor contact member to the leg and to form the table glide; and (e) the outer threaded cylinder being adapted to provide a positioning means for the floor contact member;

(f) the outer threaded cylinder being hollow;

(g) the outer threaded cylinder having inner threads and outer threads;

(h) the threaded glide mount having a tamper proof head and a threaded member; and (j) the threaded member being adapted to fit into threaded relation with a threaded insert mounted within the table leg.

2. The table glide of claim 1 further comprising:

(a) the outer threads being adapted to have male-female relationship with a threaded insert of the securing means;

(b) a threaded aperture receiving the threaded insert at the outer threads thereof; and (c) the outer threaded cylinder receiving the threaded member at the inner threads thereof.

3. The table glide of claim 2 further comprising:

(a) the outer threaded cylinder having a collar head secured thereto;

(b) the collar head being oppositely disposed from the floor contact member;

(c) the collar head being within an interior of the table leg;

(d) the outer threads providing the positioning by permitting an adjustment of length for the table glide; and (e) the inner threads securing the floor contact member to the table leg.

4. A table leg for a table with a table glide permanently secured to the table leg comprising:

(a) the table leg including a leg tube with a closure member;

(b) the closure member having an end cap and a travel cylinder;

(c) the end cap having the travel cylinder extending therefrom;

(d) the leg tube receiving the travel cylinder;

(e) the end cap stopping the closure member with the travel cylinder in the leg tube;

(e) the end cap being secured to the leg tube in order to secure the closure member in the leg tube;

(f) the travel cylinder having a threaded insert in a side thereof;

(g) a leg tube aperture communicating with a threaded aperture;

(h) the table glide having a mounting member secured to a floor contact member;

(i) the threaded insert receiving the mounting member;

(j) the mounting member being adapted to secure the floor contact member to the leg; and (k) the table glide being secured to the table leg.

5. The table leg of claim 4 further comprising:

(a) the leg tube having the closure member permanently secured thereto; and (b) the table glide being permanently secured to the table leg.

6. The table leg of claim 5 further comprising:

(a) the threaded insert receiving a threaded cylinder;

(b) the threaded cylinder having outer threads and inner threads;

(c) the table glide including a floor contact member and a tamper proof fastener;

(d) the tamper proof fastener being received by the inner threads; and (e) the tamper proof fastener securing the floor contact member to the table leg.

7. The table leg of claim 6 further comprising:

(a) the threaded cylinder having an inner end within the table leg;

(b) a collar head being secured to the inner end of the threaded cylinder;

(c) the tamper proof fastener having screw threads and an unremovable head;

(d) the screw threads having male-female relationship with the inner threads of the threaded insert; and (e) the threaded insert receiving the outer threads.

8. The table leg of claim 7 further comprising:

(a) the floor contact member having a glider surface for contacting a floor; and (b) the floor contact member having a recessed portion adjacent to the glider surface for receiving the unremovable head and avoiding contact with the floor by the unremovable head.

9. The table leg of claim 8 further comprising;

(a) the mounting member being adapted to cooperate with a securing means on the leg in order to permanently secure the floor contact member to the leg and to form the table glide; and (b) the threaded cylinder being adapted to provide a positioning means for the floor contact member;

(c) the positioning means for the floor contact member providing and up and down motion for the floor contact member.

10. In a table having at least one leg and at least one table glide mounted on the at least one leg; the improvement comprising:

(a) the at least one table glide having a mounting member and a floor contact member adapted for a permanent attachment of the at least one cable glide to the at least one leg of a table;

(b) the mounting member being secured to the floor contact member;

(b) the mounting member being adapted to permanently secure the floor contact member to the leg;

(c) the mounting member including an outer threaded cylinder and a threaded glide mount;

(d) the mounting member being adapted cooperate with a securing means on the leg in order to permanently secure the floor contact member to the leg and to form the table glide; and (e) the outer threaded cylinder being adapted to provide a positioning means for the floor contact member;

(f) the outer threaded cylinder being hollow;

(g) the outer threaded cylinder having inner threads and outer threads;

(h) the threaded glide mount having a tamper proof head and a threaded member; and (i) the threaded member being adapted to fit into threaded relation with a threaded insert mounted within the table leg.

11. The table of claim 10 further comprising:

(a) the outer threads being adapted to have male-female relationship with a threaded insert of the securing means;

(b) a threaded aperture receiving the threaded insert at the outer threads thereof; and (c) the outer threaded cylinder receiving the threaded member at the inner threads thereof.

12. The table of claim 1, further comprising:

(a) the outer threaded cylinder having a collar head secured thereto;

(b) the collar head being oppositely disposed from the floor contact member;

(c) the collar head being within an interior of the table leg;

(d) the outer threads providing the positioning by permitted an adjustment of length for the table glide; and (e) the inner threads securing the floor contact member to the table leg.

13. The table of claim 12 further comprising:

(a) the table leg including a leg tube with a closure member;

(b) the closure member having an end cap and a travel cylinder;

(c) the end cap having the travel cylinder extending therefrom;

(d) the leg tube receiving the travel cylinder;

(e) the end cap stopping the closure member with the travel cylinder in the leg tube;

(e) the end cap being secured to the leg tube in order to secure the closure member in the leg tube;

(f) the travel cylinder having a threaded insert in a side thereof;

(g) a leg tube aperture communicating with the threaded aperture;

(h) the table glide having a mounting member secured to a floor contact member;

(i) the threaded insert receiving the mounting member;

(j) the mounting member being adapted to secure the floor contact member to the leg; and (k) the table glide being secured to the table leg.

14. The table of claim 13 further comprising:

(a) the leg tube having the closure member permanently secured thereto; and (b) the table glide being permanently secured to the table leg.

15. The table of claim 14 further comprising:

(a) the threaded insert receiving the outer threaded cylinder;

(b) the outer threaded cylinder having outer threads and inner threads;

(c) the table glide including a floor contact member and a tamper proof fastener;

(d) the tamper proof fastener being received by the inner threads; and (e) the tamper proof fastener securing the floor contact member to the table leg.

16. The table of claim 15, further comprising:

(a) the outer threaded cylinder having an inner end within the table leg;

(b) a collar head being secured to the inner end of the outer threaded cylinder;

(c) the tamper proof fastener having screw threads and an unremovable head;

(d) the screw threads having male-female relationship with the inner threads or the threaded insert; and (e) the threaded insert receiving the outer threads.

17. The table of claim 16 further comprising:

(a) the floor contact member having a glider surface for contacting a floor; and (b) the floor contact member having a recessed portion adjacent to the glider surface for receiving the unremovable head and avoiding contact with the floor by the unremovable head.

18. The table of claim 17 further comprising:

(a) the mounting member being adapted to cooperate with the securing means on the leg in order to permanently secure the floor contact member to the leg and to form the table glide; and (b) the outer threaded cylinder being adapted to provide a positioning means for the floor contact member;

(c) the positioning means for the floor contact member providing and up and down motion for the floor contact member.

* * * * *